United States Patent [19]

Janke et al.

[11] Patent Number: 4,530,218

[45] Date of Patent: Jul. 23, 1985

[54] REFRIGERATION APPARATUS DEFROST CONTROL

[75] Inventors: Donald E. Janke, Benton Township, Berrien County; William J. Linstromberg, Lincoln Township, Berrien County, both of Mich.

[73] Assignee: Whirlpool Corporation, Benton Harbor, Mich.

[21] Appl. No.: 583,483

[22] Filed: Feb. 27, 1984

[51] Int. Cl.[3] ..... F25D 21/06

[52] U.S. Cl. ..... 62/156

[58] Field of Search ..... 62/151, 156, 202, 140; 236/68 C

[56] References Cited

U.S. PATENT DOCUMENTS

| | | | |
|---|---|---|---|
| 3,013,399 | 12/1961 | Simmons et al. | 62/151 |
| 3,029,610 | 4/1962 | Armentrout | 62/202 X |
| 3,138,006 | 6/1964 | Moorman et al. | 62/202 X |
| 3,188,828 | 6/1965 | Wayne | 62/140 |
| 3,383,877 | 5/1968 | Liebermann et al. | 62/140 |
| 3,518,841 | 7/1970 | West, Jr. | 62/156 X |
| 3,946,286 | 3/1976 | Kinnunen et al. | 317/124 |
| 4,269,035 | 5/1981 | Gelbard | 62/156 X |

FOREIGN PATENT DOCUMENTS

WO83/00211 1/1983 PCT Int'l. Appl. ..... 62/156

OTHER PUBLICATIONS

"ALTECH Frost Senzor RA3 Electronic Demand Defrost Controller"-Altech Controls Corporation.

*Primary Examiner*—Harry B. Tanner

*Attorney, Agent, or Firm*—Wood, Dalton, Phillips, Mason & Rowe

[57] ABSTRACT

An improved demand defrost control system for use in a refrigeration apparatus. The control system utilizes a temperature responsive switch for switching the apparatus between "run" and "defrost" conditions. The temperature responsive switch is arranged to have controlled heat transfer relationship with the cooling system, and in the illustrated embodiment, is mounted in spaced relationship to the evaporator in the flow path of the refrigerated air, and in a preselected insulating housing. A heater is provided for controlling the operation of the switch, and the control circuit is arranged to energize the heater upon termination of the defrost cycle to positively effect transfer of the defrost control switch back to the "run" condition. The control circuit is energy-efficient and provides redundant switching control of the defrost heater to provide a fail-safe operation.

13 Claims, 3 Drawing Figures

FIG. 1
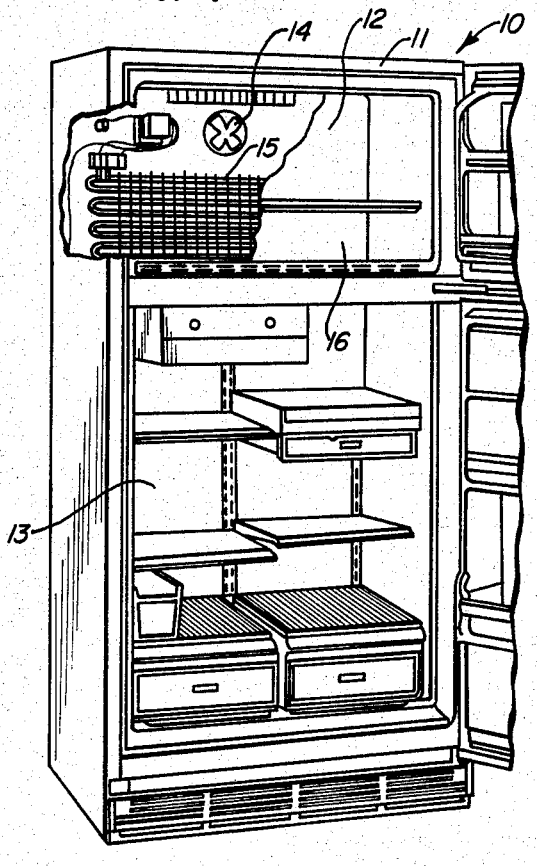
FIG. 2
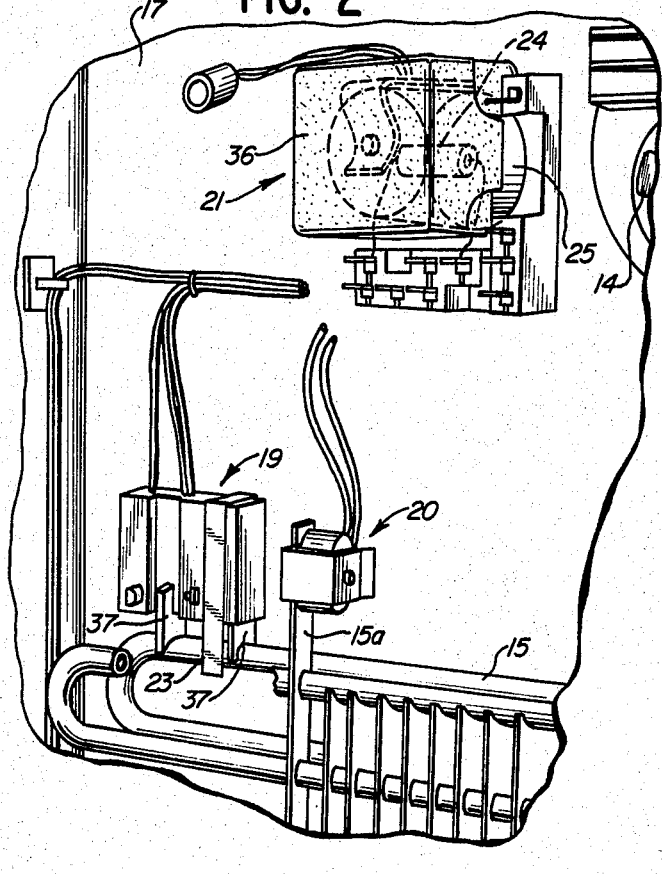
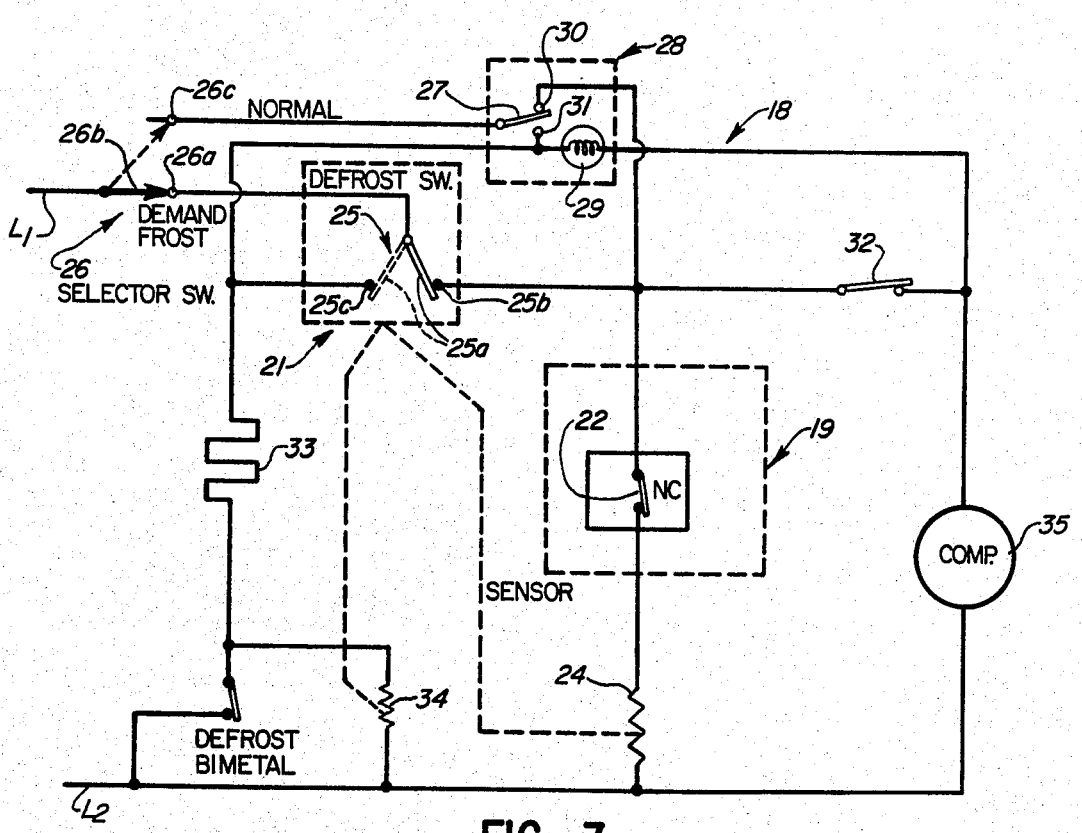
FIG. 3

REFRIGERATION APPARATUS DEFROST CONTROL

BACKGROUND OF THE INVENTION

1. Field of the Invention

This invention relates to refrigeration apparatus and in particular to a defrost control circuit for use therein with redundant switching.

2. Description of the Background Art

In the operation of refrigeration apparatus, such as refrigerator-freezer apparatus, air is cooled by flow thereof in heat transfer association with an evaporator conventionally formed of a plurality of coil turns in closely spaced relationship. As a result of the flow of the air therepast, moisture from the air is deposited on the evaporator in the form of frost. From time to time, it is necessary to remove this frost and maintain efficient operation of the refrigeration system. One conventional method of controlling the defrosting of such an evaporator is to provide timer means effecting a defrosting of the evaporator at preselected timed intervals. In one form, the timer motor is connected in the compressor motor circuit so as to measure time only during the operation of the compressor motor, thereby more accurately correlating the need for defrosting with the actual run time of the apparatus.

Still further, accurate correlation of the need for defrosting is effected by means of a demand control circuit which is responsive to a signal indicating a frosted condition of the evaporator for initiating the defrost operation. Thus, in the demand control system, a sensor is provided for detecting the buildup of frost and initiating the defrosting cycle at the appropriate time.

In one form of defrost system, defrosting heat is provided by a defrost heater which is energized electrically until a defrost bimetallic switch opens to terminate the defrost cycle.

Conventionally, upon completion of the defrost cycle, the circuit is restored to the normal operating condition wherein the compressor is operated in accordance with the cooling demand of the apparatus.

Illustratively, in U.S. Pat. No. 3,013,399 Edward C. Simmons et al disclose a refrigeration apparatus having a demand defrost control means wherein a thermostat switch selectively energizes the compressor or defrost heater. A frost sensor is provided for controlling the thermostat switch which is maintained in the defrost position by means of a bias heater energized concurrently with energization of the defrost heater. A second thermostat switch is connected in the circuit to terminate the defrost cycle and de-energize the bias heater.

A photoelectric ice detecting device is illustrated in U.S. Pat. No. 3,188,828 of Harry A. Wayne. The control utilizes a conventional relay for selectively controlling the operation of the defrost heater and refrigeration apparatus compressor.

SUMMARY OF THE INVENTION

The present invention comprehends an improved defrost control for use in such refrigeration apparatus.

The invention comprehends the provision of such a defrost control which provides a short "drip time" following the de-energization of the defrost heater and prior to the reenergization of the refrigeration system.

The invention further comprehends the provision of such a defrost control having redundant switching of the defrost heater for improved, positive repetitive operation.

Still further, the invention comprehends the provision of such a defrost control which is arranged to have high efficiency in the utilization of electrical power.

In the illustrated embodiment, the defrost control includes a defrost control switch means selectively disposed (a) in a run position for energizing the cooling means, or (b) in a defrost position for energizing the defrost heater, switch control means in substantially direct thermal transfer association with the defrost switch means for effectively maintaining the defrost switch means in the run position in the absence of a preselected amount of frost buildup on the cooling means sensed by the frost sensing means, the defrost switch means being further controlled by the switch control means to be disposed to the defrost position as an incident of the frost sensing means sensing a preselected buildup of frost on the cooling means, and circuit means for selectively (a) permitting energization of the defrost heater when the defrost switch means is in the defrost position, or (b) preventing further energization of the defrost heater and causing the switch control means to cause the defrost switch means to return to the run position as an incident of melting of the built-up frost from the cooling means by the energization of the defrost heater.

In the illustrated embodiment, the defrost switch means comprises a thermally responsive switch means and the switch control means comprises heating means in heat transfer association with the thermally responsive switch means.

In the illustrated embodiment, the circuit means comprises means for energizing the heating means, with the defrost switch in the defrost position to return the defrost switch to the run position.

In the illustrated embodiment, the defrost control further includes means for insulating the defrost switch means for causing the defrost switch to have a preselected reduced thermal transfer association with the refrigerated airstream suitable to permit the switch control means to maintain the switch in the run position in the absence of frost buildup.

Further more specifically, in the illustrated embodiment, the circuit means includes a thermally responsive switch having substantially direct heat transfer association with the cooling means for selectively controlling energization of the defrost heater as a function of the cooling means temperature, the means for causing the switch control means to cause the defrost switch means to effectively positively return to the run position as an incident of the thermally responsive switch opening to terminate energization of the defrost heater.

In the illustrated embodiment, the switch control means comprises electrically energizable heating means.

In the illustrated embodiment, the circuit means includes means for energizing the heating means, the circuit means including means for energizing the heating means as an incident of the circuit means being arranged to prevent further energization of the defrost heater.

In the illustrated embodiment, the frost sensing means is in direct thermal transfer association with the cooling means.

The defrost switch means, in the illustrated embodiment, comprises a thermally responsive switch enclosed in an insulating housing providing limited heat transfer therethrough. Means are provided for conducting an airstream in heat transfer association with the cooling means, and mounting means for disposing the insulated housing in the airstream.

In the illustrated embodiment, the defrost switch means is mounted in the refrigerated airstream downstream of the cooling means, out of direct thermal transfer relationship with the cooling means.

The temperature at which the defrost switch moves to the run position, in the illustrated embodiment, is approximately 50° F. higher than the temperature at which the defrost switch moves to the defrost position.

In the illustrated embodiment, manually operable selector switch means are provided for disabling the defrost control and initiating defrost operation as a function of time. The manually operable means includes timer means for causing a defrost operation of preselected duration to occur after the cooling means has accumulated a predetermined amount of operating time.

The improved refrigeration apparatus defrost control of the present invention is extremely simple and economical of construction while yet providing the highly desirable features and advantages discussed above.

BRIEF DESCRIPTION OF THE DRAWINGS

Other features and advantages of the invention will be apparent from the following description taken in connection with the accompanying drawings wherein:

FIG. 1 is a fragmentary perspective view with portions broken away of a refrigeration apparatus having an improved defrost control embodying the invention;

FIG. 2 is a fragmentary enlarged perspective view illustrating in greater detail the improved defrost control; and FIG. 3 is a schematic wiring diagram showing the control circuitry of the control.

DESCRIPTION OF THE PREFERRED EMBODIMENT

In the illustrative embodiment of the invention as disclosed in the drawing, a refrigeration apparatus generally designated 10 comprises a cabinet 11 defining an upper freezer compartment 12 and a lower refrigerated fresh food compartment 13. The freezer and fresh food compartments are refrigerated by a flow of refrigerated air therethrough produced by a fan 14, which causes a flow of the circulated air in heat transfer association with a fin-and-tube evaporator 15 of conventional construction. The evaporator, as shown in FIG. 1, is mounted rearwardly of the wall 16 at the rear of freezer compartment 12, between wall 16 and the cabinet liner rear wall 17.

As indicated above, the moist air, in flowing in heat transfer association with the evaporator 15, tends to deposit moisture in the form of frost on the evaporator coil and fin structure, tending to reduce the free flow of air and decrease the efficiency of the refrigeration system. The present invention is concerned with an improved means for controlling defrosting of the evaporator from time to time so as to maintain high efficiency in the use of the refrigeration apparatus.

More specifically, the present invention comprehends the provision of an improved control system generally designated 18 comprising a demand defrost control system utilizing a frost sensor generally designated 19, a defrost bimetal switch generally designated 20, and a defrost control assembly generally designated 21. The defrost bimetal 20 is mounted to an end plate **15*a* of the evaporator 15**, so as to be in thermal transfer association with the evaporator, as is conventional.

In the illustrated embodiment, frost sensor 19 comprises a conventional optical frost sensor, such as the Altech RA3 frost sensor, which controls an internal normally closed frost switch 22. As will be obvious to those skilled in the art, the control circuit of the present invention may utilize other types of frost sensors, including pressure sensors, acoustical sensors, etc., and the switch 22 may be an electromechanical switch or a solid-state switching device.

As shown in FIG. 2, frost sensor 19 is mounted in direct thermal transfer association with a portion of evaporator 15 by means of a clip 23 and heat transfer supports 37 engaging the evaporator coil.

Switch 22 remains closed as long as the sensor is relatively free of frost. As shown in FIG. 3, switch 22 is connected in series with a first electrical bias heater 24, which, as shown in FIG. 2, is mounted in the defrost control assembly 21 in thermal transfer association with a single pole, double throw bimetal defrost switch 25 thereof.

As shown in FIG. 3, the moving contact **25*a* of the switch 25 is connected to a fixed terminal 26*a* of a manually operable selector switch 26 having its moving contact 26*b* connected to power supply lead L1. The moving contact is selectively engageable with a second fixed contact 26*c* connected to the moving contact 27 of a conventional defrost timer generally designated 28. The timer further includes a timer motor 29 and suitable cams (not shown) for selectively positioning movable contact 27 between a first fixed contact 30 and a second fixed contact 31. First fixed contact 30 is connected to frost sensor 19, a first fixed contact 25*b* of switch 25, and a cabinet thermostat switch 32, as shown in FIG. 3**.

Fixed contact 31 is connected to timer motor 29, a second fixed contact **25*c* of switch 25, and a conventional defrost heater 33. As further shown in FIG. 3, defrost heater 33 is connected through the bimetal defrost switch 20** to the other power supply lead L2.

A second bias heater 34, also in thermal association with switch 25, is connected from the junction of defrost heater 33 and defrost bimetal 20 to power supply lead L2. First bias heater 24 is connected between the frost sensor 19 and power supply lead L2. The compressor motor 35 is connected between the cabinet thermostat switch 32 and power supply lead L2 to complete the circuit.

Bias heater 24 is in thermal transfer association with switch 25, as shown in FIG. 2 and indicated by the dashed line in FIG. 3, so as to maintain switch 25 in the "warm" or "run" position, wherein moving contact **25*a* contacts fixed contact 25*b*. Thus, assuming that selector switch 26 is in the demand mode wherein moving contact 26*b* contacts fixed contact 26*a*, power is provided from power supply lead L1 through switch 25 and switch 32 to the compressor motor 35 so as to provide refrigerating operation of the apparatus by energization of the compressor motor under the control of the cabinet thermostat switch 32 in the normal manner. Further, power is delivered from fixed contact 25*b* through the normally closed frost sensor switch 22 to bias heater 24, which effectively maintains the switch 25 in the "warm" or "run" condition. However, when the sensor 19 senses a buildup of frost indicating that defrosting of the evaporator would be desirable, switch 22 automatically opens to de-energize the heater 24. This allows switch 25** to move to the dotted position of FIG.

3, thereby providing energy from power supply lead L1 to the defrost heater 33.

Energization of the defrost heater 33 continues until the defrost bimetal switch 20 opens in response to the temperature of the evaporator rising to a level well above freezing. Current is now conducted from the heater 33 through the second bias heater 34 so as to energize the bias heater 34 immediately upon opening of the defrost bimetal switch 20. Sufficient heat is generated by the heater 34 to cause switch 25 to be reset to the "run" position in a reasonably short period of time. This short delay in the resetting of switch 25 provides a desirable "drip time" allowing the water from the melted frost to be effectively removed from the evaporator coils before energizing the compressor motor 35. As is conventional, the defrost water is allowed to drain to the machinery compartment where it is dissipated by the heat of the compressor motor and other apparatus in the machinery space during operation of the refrigeration apparatus.

It should be noted that the circuit to the defrost heater 33 includes the switch 25 and the switch 20 in series relationship with the heater so that should either of these switches improperly fail in the condition wherein they are arranged to provide power to the defrost heater, the operation of the other switch will effectively terminate the defrost heater energization, thereby providing a fail-safe feature of the control circuit 18.

As shown in FIG. 2, the frost sensor 19 and the defrost bimetal 20 are in direct heat transfer contact with the evaporator coil 15. Defrost control assembly 21 is disposed in indirect heat transfer relationship with the evaporator 15. Assembly 21 is preferably located in the evaporator air flow path, downstream of the evaporator, spaced from the evaporator or any other large thermal mass in the air flow system. This arrangement permits a relatively small bias heater 24, 34 to be utilized for controlling the switching operation of the switch 25 between the "run" and "defrost" conditions illustrated in FIG. 3. To further facilitate the operation of defrost control assembly 21 the assembly is provided with an insulating housing 36, the insulating characteristics of which are preselected to allow some heat transfer relationship with the refrigerated air flowing therepast sufficient to cause the switch to move to the defrost or cold position, shown in FIG. 3, within a brief period after de-energization of the bias heater 24. Thus, the insulating housing 36 permits the temperature of the refrigerated air to be relatively low without affecting the transfer of the switch to the defrost condition during normal operation of the refrigeration apparatus with the heater 24 energized.

It is desirable to maintain a relatively large differential between the temperature within the housing 36 and the temperature of the refrigerated evaporator air so as to avoid undesirable throwing of the switch 25 to the cold position under conditions where the freezer is operated at very low temperatures or wherein sags in the power line voltage occur. In the illustrated embodiment, the housing 36 is preselected to provide a 52° F. temperature differential, whereas the same control apparatus without the insulating housing 36 has been found to provide only a 35° F. differential with the same size resistance heater 24. The use of insulated housing 36 also permits the use of smaller bias heaters 24, 34, thereby minimizing the energy consumption of the control 18. In the illustrated embodiment, the housing i formed of ¼" thick foam insulation.

With further reference to the illustrated embodiment the defrost control switch 25 is arranged to move to th full line "run" position of FIG. 3 at a temperature of 75 F., and to move to the dotted line "defrost" position o FIG. 3 at 25° F. The defrost bimetal switch 20 is se lected to open at a temperature of 70° F. and close at temperature of 10° F. Further, where the sensor 1 comprises an Altech RA3 sensor, each of the bias heat ers 24, 34 comprises a 4700 ohm resistor. The senso operates to control the energization of resistor 24 so a to cause it to provide approximately 1 watt of powe during normal operation when the resistor is energize through switch 22. The circuit through defrost heate 33 and bias heater 34 is arranged to provide approxi mately 3 watts of power so as to effectively return th switch 25 to the full line position of FIG. 3 upon termi nation of the "drip time" discussed above.

As indicated briefly above, the control circuit 18 ma further include a conventional defrost timer 28 whic may be selectively utilized, by manual operation o selector switch 26, to control the defrosting cycles Thus, when moving contact 26*b* of switch 26 is trans ferred from the full line position of FIG. 3 to the dotte line position, power is provided from power supply lea L1 through moving contact 27, fixed contact 30, an cabinet thermostat switch 32 to the timer motor 29. Th timer motor, in turn, is connected through the defros heater 33 and normally closed bimetal switch 20 to th power supply lead L2 so that the timer motor is ener gized whenever the compressor motor 35 is energized to accumulate running time in determining the desire initiation of the defrost cycles. Upon accumulation o sufficient compressor run time, the defrost timer 2 functions in the normal manner to switch the moving contact 27 from fixed contact 30 to fixed contact 31 thereby energizing the timer motor 29 by a series con nection with the compressor motor 35, which is now de-energized by the removal of power from fixe contact 30. At the same time, the switching of moving contact 27 to fixed contact 31 provides direct energiza tion of defrost heater 33 through defrost bimetal switch 20. In the normal operation of such a timer controlled defrost cycle, bimetal switch 20 terminates energization of the heater 33 and the timer motor times out the rest of the defrost cycle, acting as a backup for the bimetal switch.

As indicated above, frost sensor 19 may comprise a commercially available Altech RA3 frost sensor. The commercially available Altech RA3 frost sensor includes a heater and temperature responsive switch integral therewith so as to be mounted directly on the evaporator with the sensing means. Such an arrangement has been found to require a relatively large amount of heat to maintain the switch in the "run" position during operation of the refrigerator because of the high thermal transfer from the evaporator to the sensor switch. In the conventional use of such an Altech RA3 sensor, the defrosting operation continues until the defrost heater causes the evaporator temperature to rise to a level sufficient to cause the integral temperature responsive switch to open the circuit and return to the "run" position, so as to again energize the bias heater to maintain the switch in the "run" position. The present invention comprehends an improved arrangement eliminating the disadvantages of the prior art structure by mounting the defrost control switch 25 in substantially spaced relationship to the evaporator 15. The invention also comprehends the provision of the insulating housing 36 to provide further improved control of the defrost operation, as discussed above.

Further, as discussed above, the provision of the defrost bimetal switch 20 in the arrangement of circuit 18, provides redundant switching for affording highly desirable fail-safe operation of the control. Still further, the control provides substantial improvement over the prior art controls in providing a second bias heater 34 which becomes operative immediately upon de-energization of the defrost heater, eliminating the need to rely on the heat of the evaporator to effect the switching of switch 25 back to the "run" condition.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having cooling means on which frost may form during operation thereof, a defrost heater associated with the cooling means for melting such frost, an improved defrost control comprising:

thermally responsive defrost switch means in indirect heat transfer, spaced relationship with said cooling means to be alternately disposed (a) in a run position for energizing the cooling means as an incident of the temperature to which the defrost switch means is subjected being above a preselected temperature greater than the temperature of the cooling means during running thereof, or (b) in a defrost position for energizing the defrost heater;

switch control means including thermoresponsive switch means in direct thermal transfer association with said cooling means and heating means in substantially direct thermal transfer association with said defrost switch means for effectively maintaining said defrost switch means in the run position in the absence of a preselected amount of frost buildup on the cooling means sensed by said switch control means, said defrost switch means being further controlled by said heating means of the switch control means to be transferred to said defrost position as an incident of said switch control means sensing a preselected buildup of frost on the cooling means; and thermoresponsive defrost termination switch means in substantially direct heat transfer association with said cooling means for selectively (a) permitting energization of the defrost heater when said defrost switch means is in the defrost position or (b) preventing further energization of the defrost heater and causing the heating means of said switch control means to cause said defrost switch means to return to the run position as an incident of melting of the built-up frost from the cooling means by the energization of the defrost heater.

2. The refrigeration apparatus of claim 1 wherein said defrost switch is disposed in an airstream having heat transfer relationship with said cooling means, said defrost control further including means for insulating said defrost switch means for causing said defrost switch to have a preselected reduced thermal transfer association with said airstream suitable to permit said switch control means to maintain said defrost switch in said run position in said absence of frost buildup.

3. The refrigeration apparatus of claim 1 wherein said switch control means causes said defrost switch to effectively positively return to said run position after a short time as an incident of said thermally responsive defrost termination switch being arranged to terminate energization of said defrost heater.

4. The refrigeration apparatus of claim 1 wherein said defrost switch means comprises a thermally responsive switch enclosed in an insulating housing providing limited heat transfer therethrough.

5. The refrigeration apparatus of claim 1 wherein said defrost switch means comprises a thermally responsive switch enclosed in an insulating housing providing limited heat transfer therethrough, and said apparatus further includes means for flowing refrigerated air from said cooling means in heat transfer association with said housing.

6. In a refrigeration apparatus having cooling means on which frost may form during operation thereof, a defrost heater associated with the cooling means for melting such frost, an improved defrost control comprising:

thermally responsive defrost switch means in indirect heat transfer, spaced relationship with said cooling means to be alternately disposed (a) in a run position for energizing the cooling means as an incident of the temperature to which the defrost switch means is subjected being above a preselected temperature greater than the temperature of the cooling means during running thereof, or (b) in a defrost position for energizing the defrost heater;

switch control means including thermoresponsive switch means in direct thermal transfer association with said cooling means and heating means in substantially direct thermal transfer association with said defrost switch means for effectively maintaining said defrost switch means in the run position in the absence of a preselected amount of frost buildup on the cooling means sensed by said switch control means, said defrost switch means being further controlled by said heating means of the switch control means to be transferred to said defrost position as an incident of said switch control means sensing a preselected buildup of frost on the cooling means;

thermoresponsive defrost termination switch means in substantially direct heat transfer association with said cooling means for selectively (a) permitting energization of the defrost heater when said defrost switch means is in the defrost position or (b) preventing further energization of the defrost heater and causing the heating means of said switch control means to cause said defrost switch means to return to the run position as an incident of melting of the built-up frost from the cooling means by the energization of the defrost heater;

means for conducting an airstream in heat transfer association with said cooling means; and mounting means for mounting said defrost switch means in said airstream, said defrost switch means comprising thermally responsive switch means, and said switch control means comprising heating means in heat transfer association with said thermally responsive switch means.

7. The refrigeration apparatus of claim 6 wherein said mounting means comprises means for disposing said defrost switch means downstream of said cooling means.

8. In a refrigeration apparatus having cooling means on which frost may form during operation thereof, a defrost heater associated with the cooling means for melting such frost, an improved defrost control comprising:

thermally responsive defrost switch means in indirect heat transfer, spaced relationship with said cooling means to be alternately disposed (a) in a run position for energizing the cooling means as an incident of the temperature to which the defrost switch means is subjected being above a preselected temperature greater than the temperature of the cooling means during running thereof, or (b) in a defrost position for energizing the defrost heater;

switch control means including thermoresponsive switch means in direct thermal transfer association with said cooling means and heating means in substantially direct thermal transfer association with said defrost switch means for effectively maintaining said defrost switch means in the run position in the absence of a preselected amount of frost buildup on the cooling means sensed by said switch control means, said defrost switch means being further controlled by said heating means of the switch control means to be transferred to said defrost position as an incident of said switch control means sensing a preselected building of frost on the cooling means;

thermoresponsive defrost termination switch means in substantially direct heat transfer association with said cooling means for selectively (a) permitting energization of the defrost heater when said defrost switch means is in the defrost position or (b) preventing further energization of the defrost heater and causing the heating means of said switch control means to cause said defrost switch means to return to the run position as an incident of melting of the built-up frost from the cooling means by the energization of the defrost heater;

means for conducting an airstream in heat transfer association with said cooling means;

mounting means for mounting said defrost switch means in said airstream, said defrost switch means comprising thermally responsive switch means, and said switch control means comprising heating means in heat transfer association with said thermally responsive switch means; and means for insulating said defrost switch means for causing said defrost switch means to have a preselected reduced thermal transfer association with said airstream suitable to permit said heating means of said switch control means to maintain said defrost switch in said run position in said absence of frost buildup.

9. The refrigeration apparatus of claim 8 wherein said insulating means comprises a housing enclosing said defrost switch means.

10. The refrigeration apparatus of claim 8 wherein said insulating means comprises a housing enclosing said defrost switch means, and said heating means is disposed within said housing.

11. The refrigeration apparatus of claim 8 wherein said insulating means comprises a housing enclosing said defrost switch means and being formed of insulating material having a thickness preselected to provide a predetermined temperature differential between said airstream and said defrost switch means when said heating means is energized.

12. In a refrigeration apparatus arranged for operation from an electrical power source and having cooling means including an evaporator on which frost may form during the operation thereof, an electrically energizable defrost heater associated with the evaporator for melting such frost, and frost sensing means associated with said evaporator and arranged to open a normally closed switch upon sensing the buildup of a predetermined frost load, an improved defrost control comprising:

a thermally responsive defrost initiation switch mounted downstream of the evaporator, said defrost initiation switch having a first position for connecting said power source to said cooling means and a second position for connecting said power source to said defrost heater, said defrost initiation switch assuming said first position at temperatures above a preselected temperature which is greater than the temperature of the evaporator air during operation of said cooling means;

a first bias heater connected to receive power through said normally closed frost sensor switch and positioned adjacent said defrost initiation switch, whereby said bias heater is energized and maintains said defrost initiation switch above said preselected temperature until said predetermined frost load is sensed;

a thermally responsive defrost termination switch mounted on said evaporator and connected in series with said defrost heater, said defrost termination switch being closed during operation of said cooling means and arranged to open at an above-freezing temperature indicative of the completion of a defrost operation; and, a second bias heater positioned adjacent said defrost initiation switch and connected in parallel with said defrost termination switch, whereby said second heater is energized upon the opening of said defrost termination switch to apply bias heat to said defrost initiation switch and cause said defrost initiation switch to return to said first position.

13. The refrigeration apparatus of claim 12 further including an insulating housing which encloses said defrost initiation switch to place said switch in indirect thermal transfer association with the evaporator airstream.

* * * * *